US006317941B1

(12) United States Patent
Hamm, Jr.

(10) Patent No.: US 6,317,941 B1
(45) Date of Patent: Nov. 20, 2001

(54) SECURITY CLUTCH

(75) Inventor: David Henry Hamm, Jr., Rehoboth, MA (US)

(73) Assignee: B. A. Ballou & Co., Inc., East Providence, RI (US)

( * ) Notice: Subject to any disclaimer, the term of this patent is extended or adjusted under 35 U.S.C. 154(b) by 0 days.

(21) Appl. No.: 09/587,919

(22) Filed: Jun. 6, 2000

(51) Int. Cl.[7] ..... A44C 7/00; A44B 21/00

(52) U.S. Cl. ..... 24/656; 24/658; 24/706.8; 63/12

(58) Field of Search ..... 24/701, 702, 705, 24/706.2, 706.6, 706.8, 707.1, 707.2, 707.4, 707.6, 633, 656, 657, 658, 66.6, 115 G, 537; 63/12, 3, 3.1

(56) References Cited

U.S. PATENT DOCUMENTS

| | | | | |
|---|---|---|---|---|
| 1,114,869 | * | 10/1914 | Donaldson | 24/706.8 |
| 1,246,868 | | 11/1917 | Bulley . | |
| 1,277,258 | | 8/1918 | Raiche . | |
| 1,402,827 | * | 1/1922 | Arkin | 24/706.8 |
| 3,523,339 | * | 8/1970 | La Viano | 24/706.6 |
| 3,765,064 | | 10/1973 | Hoober et al. | 24/211 |
| 3,853,416 | * | 12/1974 | Hanan | 63/12 X |
| 3,948,547 | | 4/1976 | Gache | 285/317 |
| 4,310,953 | * | 1/1982 | Nanasi | 24/656 |
| 4,881,302 | * | 11/1989 | Lee | 24/115 G X |
| 5,529,379 | * | 6/1996 | Stocker | 297/410 |
| 5,588,309 | | 12/1996 | Chioffe | 63/12 |
| 5,823,623 | * | 10/1998 | Beck | 403/108 X |
| 5,845,378 | * | 12/1998 | Karmell et al. | 24/705 |
| 5,894,641 | | 4/1999 | Hurtz et al. | 24/658 |

* cited by examiner

*Primary Examiner*—Robert J. Sandy
(74) *Attorney, Agent, or Firm*—Barlow, Josephs & Holmes, Ltd

(57) ABSTRACT

A security clutch for a jewelry post, such as an earring post, is disclosed. The security clutch includes a housing with a top wall, a bottom wall and a side wall. An access port in the side wall and a post receiving aperture through the top wall and the bottom wall are also provided. A trigger is disposed within the housing and includes a button portion that protrudes from the housing and through the access port for manipulation by the user. A U-shaped post engaging member is disposed within the housing and is in communication with and lies in the same plane as the trigger. A spring-biasing member is connected to the U-shaped post engaging member to position the U-shaped post engaging member into partial blocking of the post receiving aperture and into engagement with the groove of a grooved post received therein. The button portion is depressed by the user, against the forces of the spring-biasing member to clear the U-shaped post engaging member from the post receiving aperture and from the groove of the grooved post to permit free movement of a jewelry post within the post receiving aperture.

5 Claims, 4 Drawing Sheets

SECURITY CLUTCH

BACKGROUND OF THE INVENTION

The present invention relates to clutches and clasps and more particularly to a security clutch for a jewelry post, such as an earring post.

Security clutches or clasps are widely used for connection to a grooved jewelry post to secure the jewelry post in place. A jewelry post is commonly provided with an ornamented end and a free end. The ornamented end, for example, may carry a pearl, gemstones, metal cast design or other decorative structure. The opposing free end is inserted through a pierced ear. The free end of the post includes at least one circumferential groove to receive a clutch or clasp on the post on the opposite side of the ear to the ornamented end to secure the entire assembly in place on the ear. The clutch releasably engages the post and is of an enlarged area to prevent accidental removal of the post from the pierced ear. A security clutch can be removed and attached to the free end of the post for installation and removal of the earring assembly on the users pierced ear. Additional circumferential grooves can also be provided to secure the clutch closer or farther away from the ornamented end in accordance with the thickness of the user's ear and their respective comfort level.

In view of the foregoing, the employment of a clasp or clutch to secure a jewelry post is critical so that it is does not fall out of the user's ear. Other non-earring jewelry posts have the same requirement. In the prior art, there have been many attempts to provide a security clutch for a grooved jewelry post. For example, the prior art includes various clutches with an integrated spring-biased locking member that obstructs a post receiving aperture positioned through the clutch. The integrated locking member typically includes a complex construction with many components and delicate springs. Many prior art devices include two opposing trigger buttons to control the positioning of a locking member located inside the housing.

As a result, these prior art devices are expensive to manufacture and labor intensive to assemble. The delicate and complicated parts are very small in size and are very difficult to assemble properly. Further, these prior art devices are difficult and cumbersome to operate by the user. In sum, these prior art devices are inadequate to meet the user's needs.

In view of the foregoing, there is a demand for an improved security clutch with a minimal number of component parts to facilitate manufacturing and assembly and to reduce cost without sacrificing quality and performance. There is also a demand for a security clutch that can install onto a standard grooved jewelry post. There is a further demand for a security clutch that has only a single trigger for ease of operation, a low profile for comfort and a positive lock.

SUMMARY OF THE INVENTION

The present invention preserves the advantages of prior art security clutches for jewelry posts. In addition, the security clutch for jewelry posts provides new advantages not found in currently known devices and overcomes many disadvantages of such currently available devices.

The invention is generally directed to the novel and unique security clutch for jewelry posts, such as grooved posts. The security clutch for a jewelry post, such as a grooved earring post, of the present invention includes a housing with a top wall, a bottom wall and a side wall. An access port in the side wall and a post receiving aperture through the top wall and the bottom wall are also provided. A trigger is disposed within the housing and includes a button portion that protrudes from the housing and through the access port for manipulation by the user. A U-shaped post engaging member is disposed within the housing and is in communication with and lies in the same plane as the trigger. A spring-biasing member is connected to the U-shaped post engaging member to position the U-shaped post engaging member into partial blocking of the post receiving aperture and into engagement with the groove of a grooved post received therein.

In operation, the button portion is depressed by the user, against the forces of the spring-biasing member to clear the U-shaped post engaging member from the post receiving aperture and from the groove of the grooved post to permit free movement of a jewelry post within the post receiving aperture. As a result, the security clutch of the present invention can be easily attached and removed from a jewelry post quickly by depressing only a single button. Further, the security clutch of the present invention easily engages with a groove of a grooved post to prevent the security clutch from being removed without first depressing the button portion.

Accordingly, it is a primary object of the instant invention to provide a security clutch for jewelry posts.

Another object of the instant invention is to provide a security clutch for jewelry posts that can be easily installed and removed.

Still further, an object of the instant invention is to provide a security clutch for jewelry posts that securely locks to a grooved jewelry post.

It is yet another object of the present invention to provide a security clutch for jewelry posts that can be locked and unlocked by depression of a single button.

A further object of the present invention is to provide a security clutch for jewelry posts that has fewer parts than prior art security clutches.

Another object of the present invention is to provide a security clutch for jewelry posts that is simple and easy to manufacture and assemble.

Yet a further object of the present invention is to provide a security clutch for jewelry posts that has a positive lock.

Another object of the present invention is to provide a security clutch for jewelry posts that can accommodate on single and multiple grooved posts.

A further object of the present invention is to provide a security clutch for jewelry posts that has a low profile.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
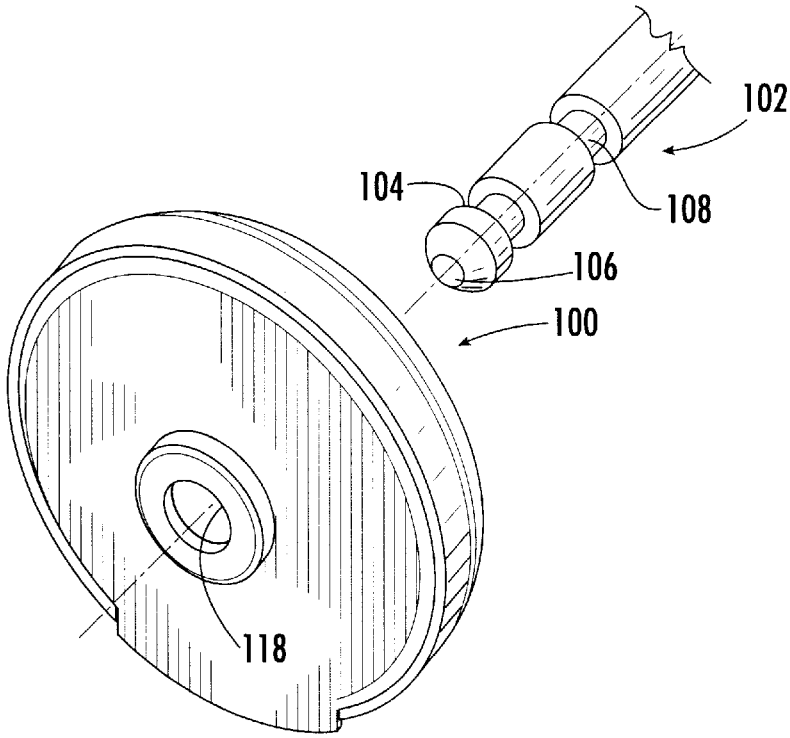
FIG. 1 is a perspective view of the security clutch of the preferred embodiment in the process of being installed on a multiple grooved jewelry post.

Referring first to FIG. 1, a perspective view of the security clutch 100 of the present invention is shown in the process of being installed on a grooved jewelry post 102. By way of example, the security clutch 100 of the present invention shown for installation onto a double groove jewelry post 102 for an earring (not shown). It should be understood that the present invention may be used to secure to any type of jewelry post 102 for a wide array of jewelry applications.

Figure 2:
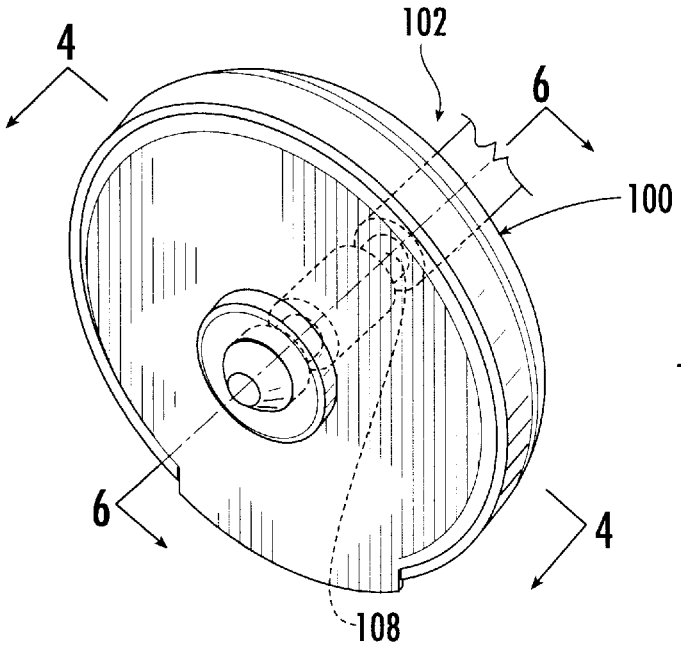
FIG. 2 is a perspective view of the security clutch of the present invention installed on a multiple grooved jewelry post.

Still referring to FIG. 1, the security clutch 100 can be attached to the shown double grooved jewelry post 102. In particular, the clutch 100 is shown being attached to the first groove 104 proximal to the end 106 of the post 102. The attachment of the security clutch 100 to the second groove 108 is identical to the attachment to the first groove 104 and need not be discussed in detail. The security clutch 100 can be secured to the free end 106 of the jewelry post 102. FIG. 2 shows the security clutch 100 of the present invention installed on the free end 106 of the jewelry post 102. The security clutch 100 can also be secured to the second groove 108 on the jewelry post 102. The construction and operation of the security clutch 100 of the present invention will be shown in detail below.

Figure 3:
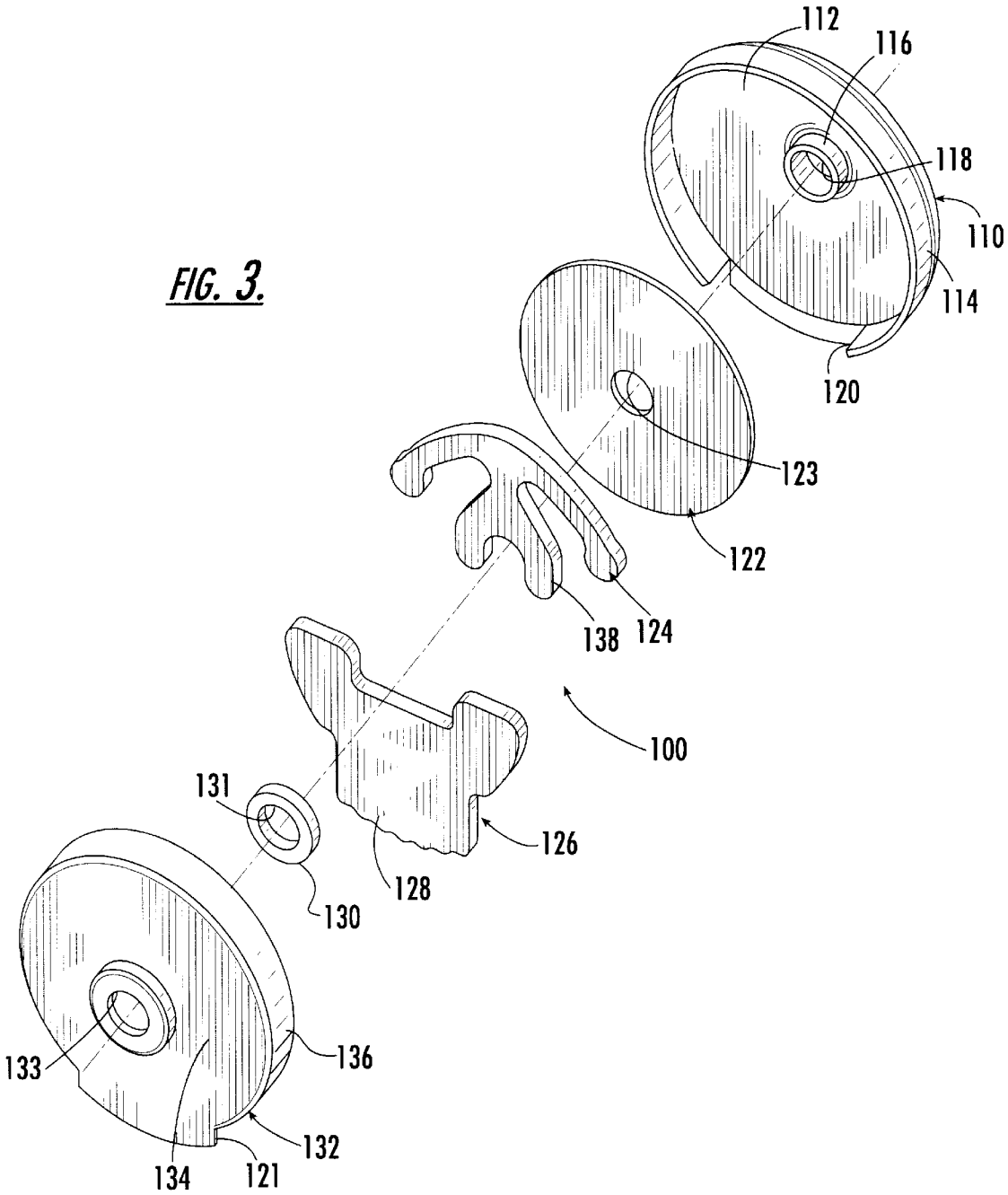
FIG. 3 is an exploded perspective view of the security clutch of the present invention.

Referring now to FIG. 3, an exploded perspective view of the security clutch 100 of the present invention is shown. An upper housing shell 110 is provided with a top plate 112 and a downwardly depending wall 114. A boss 116 is provided with an upper post receiving aperture 118 positioned therethrough. A cut-out 120 is provided in the downwardly depending wall 114. A first washer 122, with pass-through hole 123, is preferably employed and positioned within the upper housing shell 110. A spring-biased locking member 124 and trigger 126 are provided in the same plane as one another and positioned adjacent to the first washer 122 for stability. A button portion 128 of the trigger 126 extends outwardly from the upper housing shell 110 through the cut-out 120 in the downwardly depending wall 114. A second washer 130, including a pass-through hole 131 and smaller than the first washer 122, is used and positioned coaxial with the post receiving aperture 118. A lower housing shell 132 with a lower plate 134 and pass-through hole 133 and side wall 136 engages with the upper housing shell 110 so the side wall 136 of the lower housing shell 132 frictionally engages with the inner side of the downwardly depending wall 114 of the upper housing shell 110. The first washer 122, locking member 124, trigger 126 and second washer 130 are sealed within the housing formed by the upper housing shell 110 and the lower housing shell 132. For simplicity, apertures 118, 123, 131 and 133 are collectively referred to as post-receiving aperture when address the entire security clutch 100.

Figure 4:
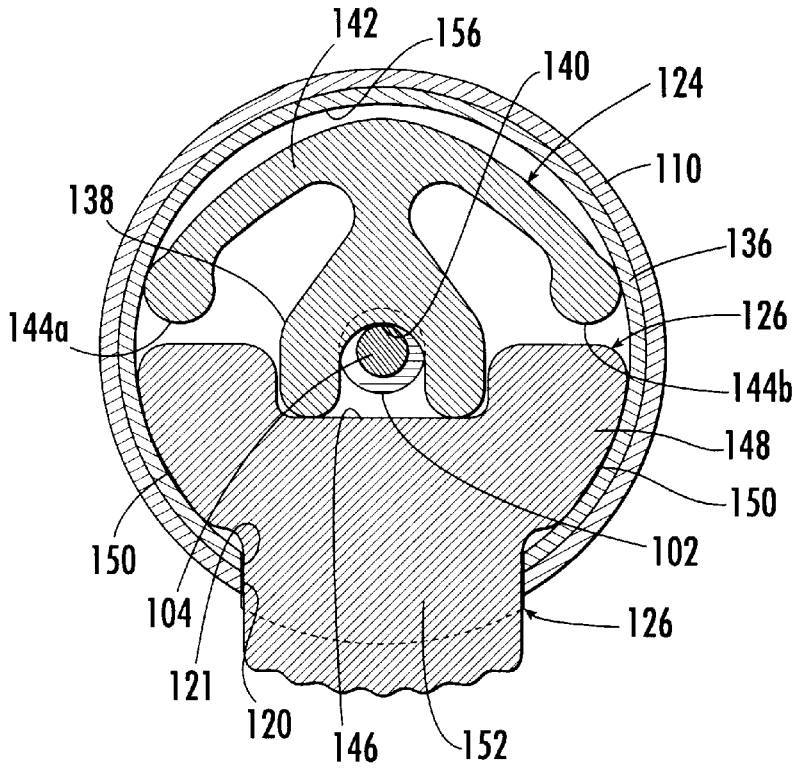
FIG. 4 is a partial cross-sectional view through the line 4—4 of FIG. 2 showing the security clutch in a locked position.
Figure 5:
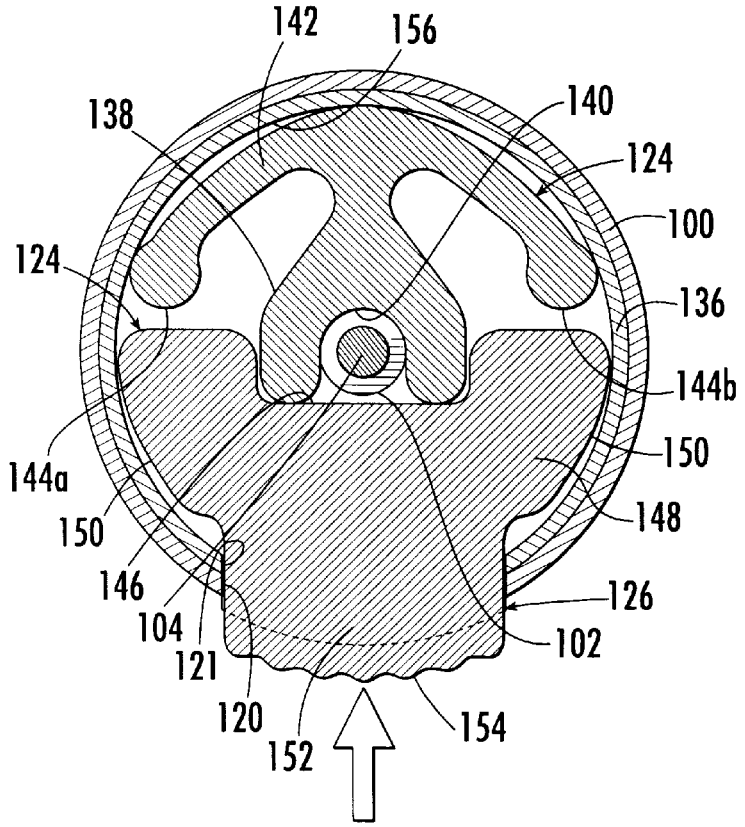
FIG. 5 the partial cross-sectional view of FIG. 4 showing the security clutch in an unlocked position.
Figure 6:
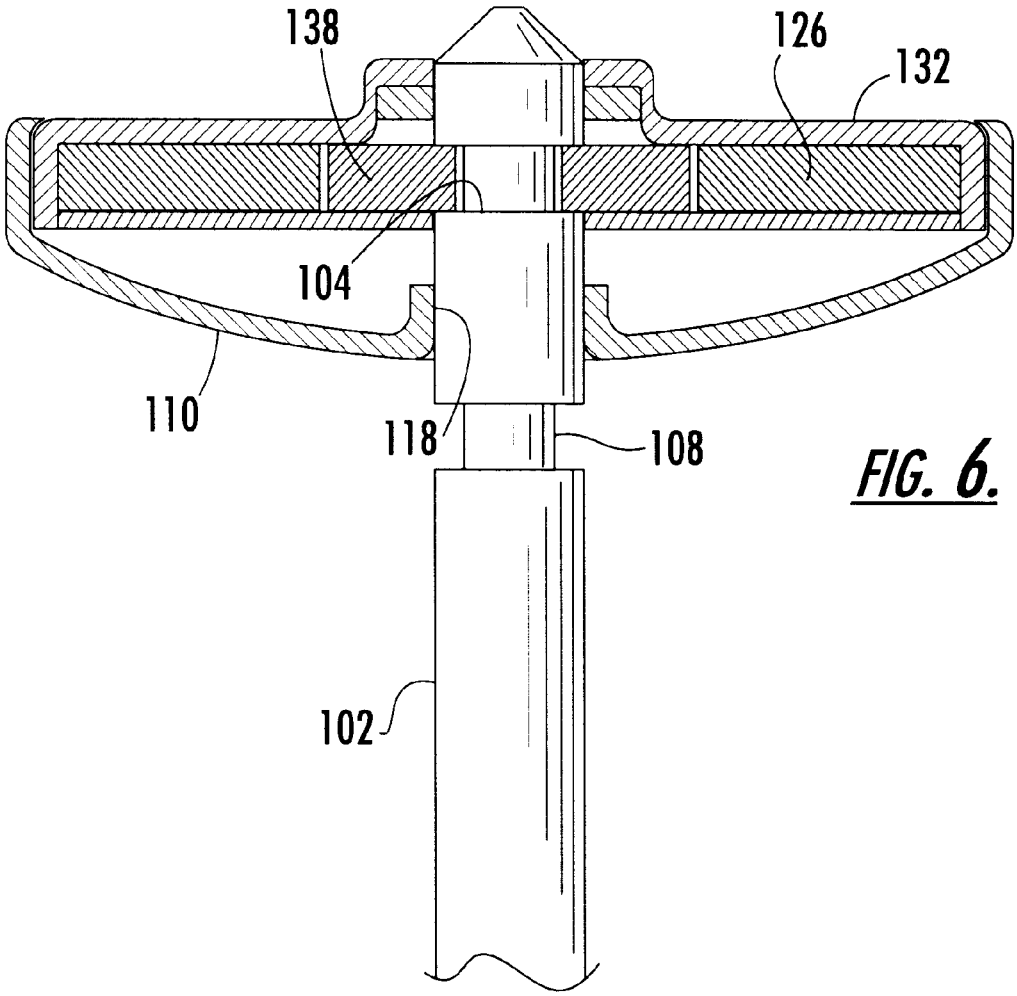
FIG. 6 is a partial cross-sectional view through the line 6—6 of FIG. 2.

Referring now to FIGS. 4–6, the construction and operation of the security clutch 100 of the present invention is shown in more detail. For ease of illustration, the lower plate 134 of the lower housing shell 132, the first washer 122 and second washer 130 are not illustrated to permit clear view of the positioning of the locking member 124 and trigger 126.

In FIG. 4, the security clutch 100 is shown in a locked state and installed on a jewelry post 102. In this condition, the device 100 is in a locked position. The locking member 124 includes a U-shaped member 138 with a post receiving surface 140. The U-shaped member 138 is connected to the mid-section of a spring member 142. The spring member includes two opposing free ends 144*a* and 144*b* which contact and bear against the inside surface of the side wall 136 of the lower housing 132. In the FIG. 4, the spring member 142 urges the U-shaped member 138 toward the post receiving aperture 118 (not shown in FIGS. 4 and 5) so that the post receiving surface 140 of the U-shaped member 138 resides within the post receiving aperture 118 and is engaged with the groove 104 of post 102. As shown both in FIGS. 4 and 6, a grooved post 102 positioned within the post receiving aperture 118 receives the U-shaped member 138 so that the U-shaped member 138 seats within the groove 104 of the post 102 in a positive locking fashion to be secured in place by the spring-biasing of the spring member 142. A double-grooved post 102 is shown in FIG. 6 as an example of the type of post 102 that can be accommodated by the security clutch 100 of the present invention. The clutch 100 is shown engaged with the top groove 104; however, the clutch 104 may be easily positioned on the lower groove 108 to suit the desired positioning of the clutch 100 on the post 102.

In this locked condition, the U-shaped member 138, with the spring-biasing of the spring member 142, bears on the leading bearing edge 146 of the contact plate 148 of the trigger 126 to urge the trigger 126 against the opposite side of the side wall 136 of the lower housing shell 132. The arcuate opposing surfaces 150 of the contact plate 148 rest against the inside surface of the side wall 136 of the lower housing shell 132. This serves as a stop to prevent over travel of the U-shaped member 138. The button portion 152 of the trigger 126 is connected, preferably integrally, to the contact plate 148 and protrudes outside the lower housing shell 132 and the upper housing shell 110 through respective cut-outs 120 and 121 therein. A roughened surface 154 is provided on the button portion 152 of the trigger 126 for improved grip by the user.

In FIG. 5, the unlocking of the device 100 is shown. The button portion 152 of the trigger 126 is depressed in a direction, as shown by the indicated arrow, toward the post 102 so that the bearing surface 146 of the contact plate 148 of the trigger 126 urges the U-shaped member 138 away from the post 102 against the spring-biasing forces of the spring member 142. As a result of the depression of a single button 152, the U-shaped member 138 is cleared from the post 102 to permit free travel of the post 102 therein. The opposing side of the spring 142, that is not connected to the U-shaped member 138, bears against the inner surface 156 of the side wall 136 of the lower housing shell 132 to serve as a stop to prevent over travel of the U-shaped member 138 away from the post 102.

In operation, to install the security clutch 100 of the present invention, the button portion 152 of the trigger 126 is depressed to clear the post 102. A grooved post 102 is inserted into the post receiving aperture 118 with the groove 104 aligned with the security clutch 100. The button portion 152 of the trigger 126 is released whereby the U-shaped member 138 engages the groove 104 of the post 102 thus positively locking the clutch 100 to the post 102. To remove the clutch 100 from the post 102, the button portion 152 is again depressed and the post 102 is removed from the cleared post receiving aperture 118.

It is preferred that the components of the security clutch 100 of the present invention be manufactured of metal, such as ferrous and non-ferrous metal. For example, spring-biased locking member 124 is, preferably, 420 stainless steel while all other components are, preferably, gold. However, other materials, such as plastic may be used to suit the application. It is also preferred that the trigger 126 travel as little as possible to facilitate operation. For example, the trigger 126 preferably protrudes only 0.025 inches and travels only 0.008 to unlock.

It should understood that the construction of the upper housing shell 110 and lower housing shell 132 may be modified in accordance with the application at hand and still be within the scope of the present invention. For example, molded or cast housing may be employed instead of the preferred mating shell construction discussed above. Further, a first washer 122 and second washer 130 are provided for spacing and for maintaining the trigger 126 in line with the U-shaped member 138, and spring assembly 142. However, the first washer 122 and/or second washer 130 may be omitted to facilitate assembly of the security clutch 100 of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A security clutch for a jewelry post with a circumferential groove, comprising:

a housing including a top plate and a bottom plate and a wall extending therebetween; said housing defining a post receiving aperture extending through said top plate and said bottom plate; said wall defining an access port therethrough;

a spring member disposed in said housing and between said top plate and said bottom plate; said spring member including two opposing free ends; said free ends being in communication with said wall of said housing;

a U-shaped locking member; said U-shaped locking member including a bottom portion connected to said spring member midway between said two opposing free ends of said spring member; said U-shaped locking member further defining a locking notch and two bearing surfaces;

a trigger disposed in said housing and between said top plate and said bottom plate and in the same plane as said U-shaped locking member; said trigger including a button and a contact plate with a leading bearing edge; said button and said contact plate being connected to one another; said button of said trigger extending out from said housing through said access port; said contact plate residing completely within said wall and between said top plate and said bottom plate; said leading bearing edge of said contact plate being in spring-biased communication with said two bearing surfaces of said spring member; and said U-shaped locking member being movable, by depression of said button against the biasing force of said spring member, from a resting locked position with said U-shaped locking member partially blocking said post receiving aperture and residing within said circumferential groove of said jewelry post, thereby securing said jewelry post relative to said housing, to an unlocked position with said U-shaped locking member being clear of said post receiving aperture, thereby permitting free passage of said jewelry post within said post receiving aperture.

2. The security clutch of claim 1, wherein said housing further includes a bottom shell and a top shell mated together.

3. The security clutch of claim 1, further comprising:

a top washer, defining a top washer aperture, disposed between said trigger and said top plate; said top washer aperture being coaxial with said post receiving aperture.

4. The security clutch of claim 1, further comprising:

a bottom washer, defining a bottom washer aperture, disposed between said trigger and said bottom plate; said bottom washer aperture being coaxial with said post receiving aperture.

5. The security clutch of claim 1, wherein said housing, said spring member, said U-shaped locking member and said trigger are manufactured of metal.

* * * * *